US009465328B2

(12) United States Patent
Sakamoto et al.

(10) Patent No.: US 9,465,328 B2
(45) **Date of Patent: *Oct. 11, 2016**

(54) TRANSFER MEMBER AND IMAGE FORMATION APPARATUS

(71) Applicant: Konica Minolta, Inc., Tokyo (JP)

(72) Inventors: Sadaaki Sakamoto, Tokyo (JP); Akihiro Honya, Tokyo (JP); Ryo Nakayama, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 67 days.

This patent is subject to a terminal disclaimer.

(21) Appl. No.: 14/211,580

(22) Filed: Mar. 14, 2014

(65) Prior Publication Data

US 2014/0286682 A1 Sep. 25, 2014

(30) Foreign Application Priority Data

Mar. 25, 2013 (JP) ..... 2013-061489

(51) Int. Cl.
*G03G 15/01* (2006.01)
*G03G 15/16* (2006.01)

(52) U.S. Cl.
CPC ..... *G03G 15/162* (2013.01)

(58) Field of Classification Search
CPC ..... G03G 15/1605; G03G 15/162; G03G 15/1685; Y10T 428/2982; Y10T 428/31551
USPC ..... 399/302; 428/423.1
See application file for complete search history.

(56) References Cited

U.S. PATENT DOCUMENTS

2007/0286957 A1* 12/2007 Suzuki et al. ..... 427/372.2
2012/0064350 A1* 3/2012 Honya et al. ..... 428/411.1
2015/0220026 A1* 8/2015 Honya et al. ..... 428/411.1

FOREIGN PATENT DOCUMENTS

JP 10-207242 A 8/1998
JP 11-267583 A 10/1999
JP 2000310912 A 11/2000
JP 2003131492 A 5/2003
JP 2004334029 A 11/2004
JP 2007025288 A 2/2007
JP 2007-212921 A 8/2007
JP 2008-076942 A 4/2008
JP 2010256719 A * 11/2010 ..... G03G 15/16
JP 2012-145677 A 8/2012

OTHER PUBLICATIONS

Office Action dated Feb. 3, 2015 from the corresponding Japanese patent application No. 2013-061489 and its English translation.

* cited by examiner

*Primary Examiner* — Thao T Tran
(74) *Attorney, Agent, or Firm* — Lucas & Mercanti, LLP

(57) ABSTRACT

A transfer member having high durability while having an excellent transfer function is provided. An image formation apparatus in which high quality images can be obtained for an extended period of time is also provided. A transfer member having an endless belt shape and constituting an image formation apparatus of an electrophotographic system includes an elastic body layer and a surface layer formed thereon. The surface layer contains metal oxide fine particles subjected to a surface treatment, in a cured resin obtained by curing an active energy ray-curable composition that contains three ingredients of a multifunctional (meth)acrylate, a polyurethane acrylate and a polymerizable component having a low surface energy group.

8 Claims, 1 Drawing Sheet

TRANSFER MEMBER AND IMAGE FORMATION APPARATUS

CROSS REFERENCE TO RELATED APPLICATION

This Application claims the priority of Japanese Patent Application No. 2013-061489 filed on Mar. 25, 2013, which is incorporated by reference herein.

TECHNICAL FIELD

The present invention relates to a transfer member and an image formation apparatus including the transfer member.

BACKGROUND ART

In an image formation apparatus of an electrophotographic system, for example, a latent image formed on an image carrier (a photoreceptor) is developed with a toner. Then, the obtained toner image is temporarily retained on a transfer member (hereinafter, also referred to as an "intermediate transfer member") having an endless belt shape, and the toner image on the intermediate transfer member is transferred on a recording medium such as a paper sheet.

As such an intermediate transfer member, a structure in which an elastic body each as chloroprene rubber (CR) is formed on the surface of a base layer made of such as polyimide resins is adopted, in order to improve transfer functions such as paper correspondence and image quality.

Since the surface of such an intermediate transfer member is in a state of rubber, there is a problem in that foreign substances are likely to attach to the surface. As a countermeasure, a surface layer is formed on the elastic body (see Patent Literatures 1 to 6).

However, there is a problem in that a following property between the elastic body and the surface layer cannot be obtained, and accordingly, the surface layer cracks or peels, resulting in failing to obtain high durability.

CITATION LIST

Patent Literature

Patent Literature 1: Japanese Patent Application Laid-Open No. 2000-310912

Patent Literature 2: Japanese Patent Application Laid-Open No. 2004-334029

Patent Literature 3: Japanese Patent Application Laid-Open No. 2003-131492

Patent Literature 4: Japanese Patent Application Laid-Open No. 2007-25288

Patent Literature 5: Japanese Patent Application Laid-Open No. Hei. 11-267383

Patent Literature 6: Japanese Patent Application Laid-Open No. Hei. 10-207242

SUMMARY OF INVENTION

Technical Problem

The present invention has been made in view of the foregoing circumstances and has as its object the provision of a transfer member that has high durability while having an excellent transfer function. Another object of the present invention is to provide an image formation apparatus that can form high quality images for an extended period of time.

Solution to Problem

In order to achieve at least one of the above-described objects, the transfer member that reflects one aspect of the present invention is a transfer member that has an endless belt shape and constitutes an image formation apparatus of an electrophotographic system, the transfer member comprising:

an elastic body layer, and a surface layer formed on an elastic body layer, wherein the surface layer contains metal oxide fine particles subjected to a surface treatment, in a cured resin obtained by curing an active energy ray-curable composition that contains three ingredients of a multifunctional (meth)acrylate, a polyurethane acrylate and a polymerizable component having a low surface energy group.

In the above-described transfer member, the polyurethane acrylate preferably has a number average molecular weight of not less than 10,000, an elongation of not less than 250%, and a tensile strength of not less than 200 kg/cm$^2$.

In the above-described transfer member, the elastic body layer preferably contains a cross-linked rubber material.

The above-described transfer member preferably comprises a substrate, the elastic body layer is formed on the substrate, and the surface layer is formed on the elastic body layer. The substrate preferably has a layer thickness of 50 to 250 μm.

In the above-described transfer member, the metal oxide fine particles are those subjected to a surface treatment with at least one selected from the group consisting of a silane compound having any of an acryloyl group and a methacryloyl group, a silicone oil and a compound having a polyfluoroalkyl group.

Furthermore, the metal oxide fine particles preferably have a number average primary particle diameter of not smaller than 1 nm and not larger than 300 nm.

In the above-described transfer member, the polymerizable component having a low surface energy group is preferably a vinyl copolymer that has a number average molecular weight of not less than 5,000 and not more than 100,000 and that contains one or more polyorganosiloxane chains or polyfluoroalkyl chains and three or more radical polymerizable double bonds.

In order to achieve at least one of the above-described objects, the image formation apparatus that reflects one aspect of the present invention is an image formation apparatus of an electrophotographic system, comprising: a primary transfer unit that performs primary transfer of transferring a toner image electrostatically formed on an image carrier onto an intermediate transfer belt that moves in circulation; and a secondary transfer unit that performs secondary transfer of transferring an intermediate toner image formed on the intermediate transfer belt onto an image support, wherein the intermediate transfer belt is constituted by the above-described transfer member.

Advantageous Effects of Invention

According to the above-described transfer member, the surface layer contains the metal oxide fine particles subjected to a surface treatment, in the cured resin obtained by curing the active energy ray-curable composition. Accordingly, the transfer member has high durability while having an excellent transfer function.

According to the above-described image formation apparatus, the intermediate transfer belt is constituted by the above-described transfer member, and accordingly, high quality images can be formed for an extended period of time.

DESCRIPTION OF EMBODIMENTS

The present invention will be described in detail below.

Transfer Member:

The transfer member according to the present invention has an endless belt shape and constitutes an image formation apparatus of an electrophotographic system. In the transfer member, a surface layer is formed on an elastic body layer. The surface layer contains metal oxide fine particles subjected to a surface treatment, in a cured resin obtained by curing an active energy ray-curable composition that contains at least three ingredients of a multifunctional (meth) acrylate, a polyurethane acrylate, and a polymerizable component having a low surface energy group.

Figure 1:
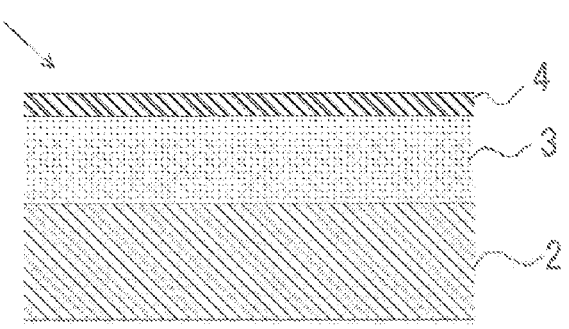
FIG. 1 is an explanatory sectional view illustrating an example of the configuration of a transfer member according to the present invention.

Specifically, in a transfer member 1 according to the present invention, as shown in FIG. 1, an elastic body layer 3 is formed on a substrate 2, and a surface layer 4 is formed on the elastic body layer 3.

Substrate 2:

The substrate 2 constituting the transfer member 1 according to the present invention has an endless belt shape, and may have either a single-layer structure or a multiple-layer structure including two or more layers.

As examples of a constituent material of the substrate 2, may be mentioned, but not particularly limited to, substances made of polyimide resins, polymethylmethacrylate resins, polycarbonate resins, polystyrene resins, acrylonitrile-styrene copolymer resins, polyvinyl chloride resins, acetate resins, ABS resins, polyester resins and polyamide resins. A substance made of polyimide resins is preferably used. Also, the substrate 2 preferably contains a conducting agent dispersed in the resins described above and has conductivity.

The layer thickness of the substrate 2 is preferably 50 to 250 μm, in view of mechanical strength, image quality, manufacturing cost and the like.

Elastic Body Layer 3:

The elastic body layer 3 constituting the transfer member 1 according to the present invention includes an elastic body. As examples of a constituent material of the elastic body, may be mentioned rubber, elastomer and resin. In particular, a cross-linked rubber material is preferably contained, from the viewpoint of compression set and the like.

As examples of the cross-linked rubber material, may be mentioned chloroprene rubber (CR), nitrile rubber (NBR) and epichlorhydrin rubber (ECO). These may be used either singly or in any combination thereof.

The layer thickness of the elastic body layer 3 is preferably 200 to 500 μm, in view of mechanical strength, image quality, manufacturing cost and the like.

Surface Layer 4:

The surface layer 4 constituting the transfer member 1 according to the present invention contains the cured resin obtained by curing the active energy ray-curable composition that contains at least three ingredients of the multifunctional (meth)acrylate, the polyurethane acrylate and the polymerizable component having a low surface energy group. Also, the metal oxide fine particles subjected to a surface treatment is contained in the cured resin.

Multifunctional (Meth)Acrylate:

The multifunctional (meth)acrylate constituting the active energy ray-curable composition has two or more (meth) acryloyloxy groups in one molecule, and is used to develop abrasion resistance, toughness and adhesion of the surface layer 4 of the transfer member 1. As specific examples thereof, may be mentioned a bifunctional monomer such as bis(2-acryloxyethyl)-hydroxyethyl-isocyanurate, 1,6-hexanediol diacrylate, 1,4-butanediol diacrylate, 1,9-nonanediol diacrylate, neopentylglycol diacrylate, hydroxy pivalic acid neopentyl glycol diacrylate and urethane acrylate; and a multifunctional monomer having three or more functional groups such as trimethylolpropane triacrylate, pentaerythritol triacrylate, tris(acryloxyethyl)isocyanurate, ditrimethylolpropane tetraacrylate, pentaerythritol tetraacrylate (PETTA), dipentaerythritol hexaacrylate (DPHA), urethane acrylate and an ester compound synthesized from a polyhydric alcohol, a polybasic acid and a (meth)acrylic acid (for example, an ester compound synthesized from trimethylol ethane, succinic acid and acrylic acid at a ratio of 2:1:4 in terms of mol). A multifunctional acrylate having three or more functional groups is desirably used so that a coated film has a hard coat property.

The number average molecular weight of the multifunctional (meth)acrylate is preferably not more than 1,000, more preferably not less than 200 and not more than 600.

When the number average molecular weight of the multifunctional (meth)acrylate falls within the above-described range, the density of the cured resin can be improved to obtain nigh strength.

In the present invention, the number average molecular weight of the multifunctional (meth)acrylate is a value measured by gel permeation chromatography using the multifunctional (meth)acrylate as a measurement sample.

The content ratio of the multifunctional (meth)acrylate is preferably 20 to 60% by mass in the active energy ray-curable composition.

Polyurethane Acrylate:

The polyurethane acrylate constituting the active energy ray-curable composition is a polymer that has a urethane bond, and one or more acryloyloxy groups in one molecule.

As an example of the polyurethane acrylate, may be mentioned a compound that has a urethane bond in a main chain and one or more acryloyloxy groups bonded to a terminal or a side chain of the main chain.

In the present invention, the polyurethane acrylate has a function of providing a following property of the surface layer 4 to the elastic body layer 3.

The number average molecular weight of the polyurethane acrylate is preferably not less than 10,000, particularly preferably not less than 10,000 and not more than 20,000.

Also, the elongation of the polyurethane acrylate is preferably not less than 250%, particularly preferably not less than 250% and not more than 400%. The tensile strength thereof is preferably not less than 200 kg/cm$^2$, particularly preferably not leas than 250 kg/cm$^2$ and not more than 350 kg/cm$^2$.

When the polyurethane acrylate has the above-described physical properties, the cured resin constituting the surface layer 4 has the following property to the elastic body layer 3 which is provided under the surface layer 4, while having scratch resistance.

In the present invention, the number average molecular weight of the polyurethane acrylate is measured in the same manner as in the above-described measurement method of the number average molecular weight of the multifunctional (meth)acrylate, except that the measurement sample is changed to the polyurethane acrylate.

In the present invention, the elongation and the tensile strength of the polyurethane acrylate are values measured with an "Autograph AGS-J" (manufactured by Shimadzu Corporation). Here, the elongation and the tensile strength described above are values obtained by measuring a sample including only the polyurethane acrylate with a thickness of 30±10 μm and a width of 15 mm.

The content ratio of the polyurethane acrylate is preferably 20 to 50% by mass in the active energy ray-curable composition.

Polymerizable Component Having a Low Surface Energy Group:

In the polymerizable component having a low surface energy group, which constitutes the active energy ray-curable composition, the low surface energy group refers to a functional group having a function of reducing the surface free energy of a surface layer. Specifically, the low surface energy group refers to a silicone-modified or fluorine-modified acrylate group. As examples of such a silicone-modified site, may be mentioned dimethylpolysiloxane and methyl hydrogen polysiloxane. As examples of the fluorine-modified site, may be mentioned polytetrafluoroethylene (PTFE) and a tetrafluoroethylene-perfluoroalkylvinylether copolymer (PFA).

As a specific example of the polymerizable component having a low surface energy group, may be mentioned a vinyl copolymer (hereinafter, also referred to as a "specific vinyl copolymer") that contains one or more polyorganosiloxane chains or polyfluoroalkyl chains and three or more radical polymerizable double bonds, and that has a number average molecular weight of not less than 5,000 and not more than 100,000.

The specific vinyl copolymer can be obtained by, for example, a reaction of a compound (B) with a vinyl polymer (A). The vinyl polymer (A) is prepared by a radical polymerization among: a monomer (a) having a radically polymerizable double bond and a polyorganosiloxane group or a polyfluoroalkyl group; a monomer (b), other than the monomer (a), having a radically polymerizable double bond and a reactive functional group; and further as necessary, a monomer (c), other than the monomer (a) and the monomer (b), having a radically polymerizable double bond. The compound (B) has a functional group capable of reacting with the reactive functional group, and a radically polymerizable double bond.

The specific vinyl copolymer can also be obtained by polymerizing the monomer (a), a monomer (c') having two or more radically polymerizable double bonds, and as necessary, the monomer (c). When the amount of the monomer (c') is small, gelation does not occur, and a desired vinyl copolymer can be obtained. Also, gelation can be further suppressed by protecting part or the whole of the monomer (c') by the addition of a blocking group to part of the radically polymerizable double bonds.

The specific vinyl copolymer having a number average molecular weight of less than 5,000 tends to be crystallized, causing productivity to be significantly reduced, and is therefore not preferable. The vinyl copolymer having a number average molecular weight of more than 100,000 has reduced surface hardness as a surface layer, causing a function as the transfer member to be reduced, and is therefore not preferable.

In the present invention, the number average molecular weight of the specific vinyl copolymer is a value measured by gel permeation chromatography manufactured by Shimadzu Corporation.

The monomer (a) is used for the purpose of reducing the surface free energy of the surface layer to a low level.

As an example of the monomer (a) which has a radically polymerizable double bond and a polyorganosiloxane group, may be mentioned a compound represented by a general formula (1) below.

[Chemical Formula 1]

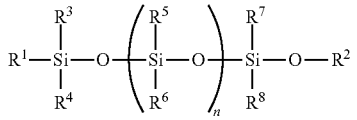

In the general formula (1), $R^1$ represents $CH_2{=}CHCH_2{-}COO{-}(CH_2)m$-, $CH_2{=}C(CH_3){-}COO{-}(CH_2)m$-, $CH_2{=}CH{-}(CH_2)m$-, or $CH_2{=}C(CH_3){-}(CH_2)m$-, (m is an integer of 0 to 10); $R^2$ represents a hydrogen atom, a methyl group, or the same functional group as $R^1$; $R^3$, $R^4$, $R^5$, $R^6$, $R^7$ and $R^8$ each independently represent an alkyl group or a phenyl group; and n represents a positive integer.

Here, a hydrogen atom represented in $R^1$ to $R^8$ may be substituted with a known substituent other than a hydrogen atom within the range not impairing the effect of the present invention.

As specific examples of the monomer (a) which has a radically polymerizable double bond and a polyorganosiloxane group, may be mentioned a polyorganosiloxane compound containing a vinyl group at one terminal, such as TSL9705 manufactured by Toshiba Silicone Co. Ltd., and a polyorganosiloxane compound containing a (meth)acryloxy group at one terminal, such as Silaplane FM-0711, FM-0721 and FM-0725 manufactured by Chisso Corporation.

As an example of the monomer (a) which has a radically polymerizable double bond and a polyfluoroalkyl group, may be mentioned perfluoroalkyl ethyl acrylate.

These monomers (a) may be used either singly or to any combination thereof depending on required performance.

The copolymerization ratio of the monomer (a) in the vinyl polymer (A) is preferably 1 to 80% by mass, further preferably 5 to 50% by mass, particularly preferably 10 to 45% by mass per a total mass of the monomers constituting the polymer, in view of a surface free energy of the surface of the surface layer of the intermediate transfer belt, compatibility with other components contained in the active energy ray-curable composition, adhesion to the elastic body layer 3, coat performance such as toughness, and solubility of the polymer in a solvent.

The monomer (b), other than the monomer (a), which has a radically polymerizable double bond and a reactive functional group provides a starting point for introducing a radically polymerizable double bond to the vinyl polymer (A) polymerized in the first stage. The introduced radically polymerizable double bond is crosslinked with active energy rays to set the vinyl polymer. Accordingly, bleeding of the vinyl polymer is suppressed to form a tough barrier wall.

As examples of the reactive functional group, may be mentioned a hydroxy group, a carboxyl group, an isocyanate group and an epoxy group.

As specific examples of the monomer (b) having a hydroxy group, may be mentioned 2-hydroxyethyl (meth) acrylate, 1-hydroxypropyl (meth)acrylate, 2-hydroxypropyl (meth)acrylate, 4-hydroxybutyl (meth)acrylate, polyethylene glycol mono(meth)acrylate, polypropylene glycol mono (meth)acrylate, polytetramethylene glycol mono(meth)acrylate and hydroxystyrene.

As specific examples of the monomer (b) having a carboxyl group, may be mentioned acrylic acid, methacrylic acid, crotonic acid, maleic acid, fumaric acid, itaconic acid and citraconic acid.

As specific examples sat the monomer (b) having an isocyanate group, may be mentioned (meth)acryloyloxyethyl isocyanate, (meth)acryloyloxypropyl isocyanate and the like; and a compound obtained through a reaction of hydrozyalkyl (meth)acrylate such as 2-hydroxyethyl (meth) acrylate and 4-hydroxybutyl (meth)acrylate with polyisocyanate such as toluene diisocyanate and isophorone diisocyanate.

As specific examples of the monomer (b) having an epoxy group, may be mentioned glycidyl methacrylate, glycidyl cinnamate, glycidyl allyl ether, glycidyl vinyl ether, vinyl cyclohexane monoepoxide and 1,3-butadiene monoepoxide. These monomers (b) may be used either singly or in any combination thereof depending on required performance.

The copolymerization ratio of the monomer (b) in the vinyl polymer (A) is preferably 10 to 90% by mass, further preferably 50 to 90% by mass, particularly preferably 40 to 85% by mass per a total mass of the monomers constituting the polymer, in view of scratch resistance, hardness, surface free energy and the like of the surface layer of the intermediate transfer belt.

The monomer (c), other than the monomer (a) and the monomer (b), having a radically polymerizable double bond is used in order to improve compatibility with other components contained in the vinyl polymer and the active energy ray-curable composition, and to provide physical properties such as hardness, toughness, scratch resistance and the like of the surface layer of the intermediate transfer belt.

As examples of the monomer (c), may be mentioned (I) acrylic acid derivatives, (II) aromatic vinyl monomers, (III) olefin-based hydrocarbon monomers, (IV) vinyl ester monomers, (V) vinyl halide monomers and (VI) vinyl ether monomers.

As specific examples of (I) (meth)acrylic acid derivatives, may be mentioned (meth)acrylonitrile; alkyl (meth)acrylate such as methyl (meth)acrylate, butyl (meth)acrylate, ethylhexyl (meth)acrylate and stearyl (meth)acrylate; and benzyl (meth)acrylate.

As specific examples of (II) aromatic vinyl monomers, may be mentioned styrenes such as styrene, methylstyrene, ethylstyrene, chlorostyrene, monofluoromethyl styrene, difluoromethyl styrene and trifluoromethyl styrene.

As specific examples (III) olefin-based hydrocarbon monomers, may be mentioned ethylene, propylene, butadiene, isobutylene, isoprene and 1,4-pentadiene.

As a specific example of (IV) vinyl ester monomers, may be mentioned vinyl acetate.

As specific examples of (V) vinyl halide monomers, may be mentioned vinyl chloride and vinylidene chloride.

As a specific example of (VI) vinyl ether monomers, may be mentioned vinyl methyl ether. These monomers may be used either singly or in any combination thereof.

The copolymerization ratio of the monomer (c) in the vinyl polymer (A) is preferably 0% by mass to 89% by mass per a total mass of the monomers constituting the polymer, in view of compatibility with other components contained in the vinyl polymer and the active energy ray-curable composition.

The vinyl polymer (A) can be synthesized by a publicly known method, for example, solution polymerization. As examples of a solvent to be used during the polymerization, may be mentioned ketones such as acetone, methyl ethyl ketone, methyl isobutyl ketone and cyclohexanone; ethers such as tetrahydrofuran, dioxane, ethylene glycol dimethyl ether, and diethylene glycol dimethyl ether; aromatics such as benzene, toluene, xylene and cumene; and esters such as ethyl, acetate and butyl acetate. The solvents may be used in any combination thereof. The used concentration of the monomers during the polymerization is preferably 0 to 80% by mass.

As a polymerization initiator, conventional peroxides or azo compounds are used. As examples thereof, may be mentioned benzoyl peroxide, azoisobutylvalenonitrile, azobisisobutyronitrile, di-t-butyl peroxide, t-butyl perbenzoate, t-butyl peroctoate and cumene hydroxy peroxide. The polymerization temperature is preferably 50 to 104° C., further preferably 70 to 104° C.

The preferred number average molecular weight of the obtained vinyl polymer (A) is 5,000 to 100,000.

By the reaction of the resultant vinyl polymer (A) having a reactive functional group and a polyorganosiloxane chain or a polyfluoroalkyl chain with the compound (B) having a functional group capable of reacting with the reactive functional group and a radically polymerizable double bond, the vinyl copolymer having a radically polymerizable double bond and a polyorganosiloxane chain or a polyfluoroalkyl chain can be obtained.

The vinyl polymer (A) and the compound (B) preferably undergo a reaction in such a ratio that the number of functional groups capable of reacting with the reactive functional groups contained in the vinyl polymer (A) becomes 100% with respect to the number of the reactive functional groups contained in the vinyl polymer (A). The reaction may be performed in a ratio of lower than 100% as long as optical reactivity is not impaired.

As a combination of the reactive functional group and the functional group capable of reacting with the reactive functional group, may be adopted publicly known various combinations and reaction methods as indicated below.

1) When the reactive functional group is a hydroxy group, representative examples of the functional group capable of reacting with the reactive functional group may include an acid halogen group and an isocyanate group. Specifically, a reaction with (meth)acrylic acid chloride or methacryloxy ethyl isocyanate can cause a radically polymerizable double bond to be introduced. The reaction with (meth)acrylic acid chloride is proceeded by adding a catalyst in a solution of a polymer having a polyorganosiloxane chain or a polyfluoroalkyl chain and a hydroxyl group, adding (meth)acrylic acid chloride in the solution, and heating the mixture. As a solvent, can be used ketones such as 2-butanone, methyl isobutyl ketone and cyclohexanone; esters such as ethyl acetate, propyl acetate and butyl acetate; and ethers such as ethylene glycol dimethyl ether and dioxolane. As the catalyst, triethylamine, dimethyl benzyl amine and the like are preferable. The amount of the catalyst to the solid content is 0.1% by mass to 1% by mass. The reaction is performed under air to suppress gelation. The reaction temperature is 80° C. to 120° C. The reaction time is one hour to 24 hours.

The reaction with methacryloxy ethyl isocyanate is proceeded by adding, as a catalyst, metal compounds such as tin octylate, tin dibutyl dilaurate or zinc octylate, or tertiary amines soon as triethylamine, tributylamine or dimethyl benzyl amine in an amount of 0.05 PHR to 1 PHR (Per hundred Resin), in a solution of a polymer having a polyorganosiloxane chain or a polyfluoroalkyl chain and a hydroxyl group, and adding under heating methacryloxyethyl methacrylate in the solution. As a solvent, can be used ketones such as 2-butanone, methyl isobutyl ketone and cyclohexanone; esters such as ethyl acetate, propyl acetate and butyl acetate; and ethers such as ethylene glycol dimethyl ether and dioxolane.

2) When the reactive functional group is an epoxy group, a representative example of the functional group capable of reacting with the reactive functional group may include a carboxyl group. Specifically, a reaction with (meth)acrylic acid can cause a radically polymerizable double bond to be introduced. The reaction with (meth)acrylic acid is proceeded by adding a catalyst in a solution of a polymer having a polyorganosiloxane chain or a polyfluoroalkyl chain and a hydroxyl group, adding (meth)acrylic acid in the solution, and heating the mixture. As a reaction condition, the same condition as in 1) described above where the reactive functional group is a hydroxy group is recommended. Further, tertiary amine is most preferable as a catalyst. As a compound that has a carboxyl group and a radically polymerizable double bond, may be mentioned, other than (meth) acrylic acid, a pentaerythritol triacrylate succinic anhydride adduct and (meth)acryloxyethyl phthalate.

3) When the reactive functional group is an isocyanate group, a representative example of the functional group capable of reacting with the reactive functional group may include a hydroxyl group. As specific examples thereof, may be mentioned hydroxyethyl (meth)acrylate, hydroxypropyl (meth)acrylate, hydroxybutyl (meth)acrylate and an ϵ-caprolactone adduct of hydroxyethyl (meth)acrylate. As a reaction condition, the same condition as in 1) described above where the reactive functional group is a hydroxy group is preferable.

Based on the whole mass of non-volatile components of the active energy ray-curable composition, the contained amount of the monomer (a) having a polyorganosiloxane chain or a polyfluoroalkyl chain may be 0.01 to 10% by mass. The vinyl copolymer having a number average molecular weight of 5,000 to 100,000 and containing one polyorganosiloxane chain or polyfluoroalkyl chain and three or more radical polymerizable double bonds has a property of being concentrated on the surface when the elastic body layer 3 is coated with the active energy ray-curable composition. Therefore, a sufficiently low surface free energy can be developed even with a small amount of the monomer (a).

As the above-described vinyl copolymer having a number average molecular weight of not less than 5,000 and not more than 100,000 and containing one or more polyorganosiloxane chains or polyfluoroalkyl chains and three or more radical polymerizable double bonds, which is the polymerizable component having a low surface energy group, can be used a commercially available "Megafac" (manufactured by DIC Corporation) or "FulShade" (manufactured by Toyo Ink Co., Ltd.).

The content ratio of the polymerizable component having the low surface energy group is preferably 1 to 30% by mass in the active energy ray-curable composition.

In the cured resin obtained by curing the above-described active energy ray-curable composition, the content ratio of a structural unit derived from the multifunctional (meth)acrylate is preferably 20 to 60% by mass; the content ratio of a structural unit derived from the polyurethane acrylate is preferably 20 to 50% by mass; and the content ratio of a structural unit derived from the polymerizable component having a low surface energy group is preferably 1 to 30% by mass.

Metal Oxide Fine Particles:

In the surface layer 4 constituting the transfer member 1 according to the present invention, the metal oxide fine particles subjected to a surface treatment are contained. By containing the metal oxide fine particles in the surface layer 4, the surface layer 4 can have toughness and high durability.

The metal oxide fine particles can be obtained by performing a surface treatment on metal oxide fine particles that have not been untreated (hereinafter, also referred to as "untreated metal oxide fine particles") with a surface treatment agent.

The untreated metal oxide fine particles used is the present invention may be an oxide of a metal, including a transition metal. As examples thereof, may be mentioned silica (silicon oxide), magnesium, oxide, zinc oxide, lead oxide, aluminum oxide, tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide and vanadium oxide. Among these, titanium oxide, alumina, zinc oxide, tin oxide and the like are preferable. In particular, alumina and tin oxide are preferable.

These untreated metal oxide fine particles to be used are manufactured by a common manufacturing method such as a gas phase method, a chloride method, a sulfuric acid method, a plasma method and an electrolytic method.

The number average primary particle diameter of the untreated metal oxide fine particles is preferably within a range of not smaller than 1 nm and not larger than 300 nm. Particularly preferable is 3 to 100 nm. When the particle diameter is small, abrasion resistance is not sufficient. Also, when the particle diameter is large, a writing light may be scattered, or the particles may inhibit light curing, resulting in insufficient abrasion resistance.

The number average primary particle diameter of the untreated metal oxide fine particles is a value obtained by photographing an enlarged picture at a magnification of 10000 times with a scanning electron microscope (manufactured by JEOL Ltd.), and calculating the number average primary particle diameter based on a randomly scanned picture image of 300 particles (aggregated particles excluded) using an automatic image processing analyzer "LUZEX AP" (manufactured by Nireco Corporation) software version Ver. 1.32.

As an example of the surface treatment agent used in the surface treatment of the untreated metal oxide fine particles, may be mentioned a compound having a radically polymerizable functional group. As examples of the radically polymerizable functional group, may be mentioned an acryloyl group and a methacryloyl group.

Also, in order to provide a low surface energy property, a silicone oil and a compound having a polyfluoroalkyl group, for example, may be used as the surface treatment agent. As examples of the silicone oil to be used, many be mentioned a straight silicone oil (for example, methyl hydrogen polysiloxane (MHPS)) and a modified silicone oil.

In the present invention, the surfaces of the metal oxide fine particles preferably include at least one of a radically polymerizable functional group and a low surface energy functional group introduced therein. Here, the low surface energy functional group is a functional group introduced by the surface treatment agent used to provide a low surface energy property. As examples of the functional group, may be mentioned a silicone oil group and a polyfluoroalkyl group, which have been subjected to a silane coupling treatment. When both are introduced, the ratio between the radically polymerizable functional group and the low surface energy functional group is preferably 2:1 to 1:2.

As the surface treatment agent having the radically polymerizable functional group, which is used in the surface treatment of the untreated metal oxide fine particles, a compound containing, in one molecule, a functional group that has a carbon-carbon double bond, and a polar group, such as an alkoxy group, which undergoes coupling with a hydroxyl group on the surfaces of the untreated metal oxide fine particles.

As the surface treatment agent having the radically polymerizable functional group, may be suitable a compound having a functional group that is polymerized (cured) by irradiation of active energy rays such as ultraviolet rays and electron beams to be transformed into a resin such as polystyrene and polyacrylate. Especially, a silane compound having a reactive acryloyl or methacryloyl group is particularly preferable, since curing can be achieved by a small amount of light or for a short period of time.

As an example of the surface treatment agent having the radically polymerizable functional group, may be mentioned a compound represented by a general formula (2) below.

[Chemical Formula 2]

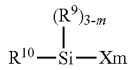

In the general formula (2), $R^3$ represents a hydrogen atom, an alkyl group having 1 to 10 carbon atoms, or an aralkyl group having 1 to 10 carbon atoms; $R^{10}$ represents an organic group having a reactive double bond; X represents a halogen atom, an alkoxy group, an acyloxy group, an aminoxy group or a phenoxy group; and m is an integer of 1 to 3.

As examples of the compound represented by the above general formula (2), may be mentioned S-1 to S-30 below.

S-1 $CH_2{=}CHSi(CH_3)(OCH_3)_2$
S-2 $CH_2{=}CHSi(OCH_3)_3$
S-3 $CH_2{=}CHSiCl_3$
S-4 $CH_2{=}CHCOO(CH_2)_2Si(CH_3)(OCH_3)_2$
S-5 $CH_2{=}CHCOO(CH_2)_2Si(OCH_3)_3$
S-6 $CH_2{=}CHCOO(CH_2)_2Si(OC_2H_5)(OCH_3)_2$
S-7 $CH_2{=}CHCOO(CH_2)_3Si(OCH_3)_3$
S-8 $CH_2{=}CHCOO(CH_2)_2Si(CH_3)Cl_2$
S-9 $CH_2{=}CHCOO(CH_2)_2SiCl_3$
S-10 $CH_2{=}CHCOO(CH_2)_3Si(CH_3)Cl_2$
S-11 $CH_2{=}CHCOO(CH_2)_3SiCl_3$
S-12 $CH_2{=}C(CH_3)COO(CH_2)_2Si(CH_3)(OCH_3)_2$
S-13 $CH_2{=}C(CH_3)COO(CH_2)_2Si(OCH_3)_3$
S-14 $CH_2{=}C(CH_3)COO(CH_2)_3Si(CH_3)(OCH_3)_2$
S-15 $CH_2{=}C(CH_3)COO(CH_2)_3Si(OCH_3)_3$
S-16 $CH_2{=}C(CH_3)COO(CH_2)_2Si(CH_3)Cl_2$
S-17 $CH_2{=}C(CH_3)COO(CH_2)_2SiCl_3$
S-18 $CH_2{=}C(CH_3)COO(CH_2)_3Si(CH_3)Cl_2$
S-19 $CH_2{=}C(CH_3)COO(CH_2)_3SiCl_3$
S-20 $CH_2{=}CHSi(C_2H_5)(OCH_3)_2$
S-21 $CH_2{=}C(CH_3)Si(OCH_3)_3$
S-22 $CH_2{=}C(CH_3)Si(OC_2H_5)_3$
S-23 $CH_2{=}CHSi(OCH_3)_3$
S-24 $CH_2{=}C(CH_3)Si(CH_3)(OCH_3)_2$
S-25 $CH_2{=}CHSi(CH_3)Cl_2$
S-26 $CH_2{=}CHCOOSi(OCH_3)_3$
S-27 $CH_2{=}CHCOOSi(OCH_2H_5)_3$
S-28 $CH_2{=}C(CH_3)COOSi(OCH_3)_3$
S-29 $CH_2{=}C(CH_3)COOSi(OC_2H_5)_3$
S-30 $CH_2{=}C(CH_3)COO(CH_2)_3Si(OC_2H_5)_3$

Also, other than the compound represented by the above general formula (2), as the compound having the radically polymerizable functional group, may be used S-31 to S-33 below.

[Chemical Formula 3]

S-31

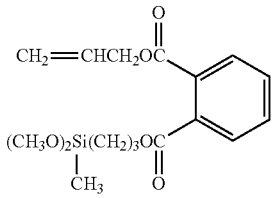

S-32

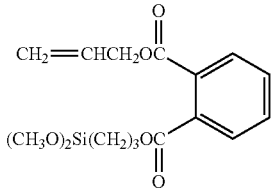

S-33

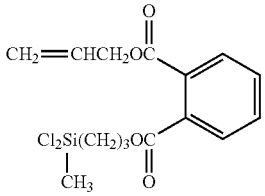

The above compounds may be used either singly or in any combination thereof.

Also, as the surface treatment agent, may be used an epoxy-based compound shown in S-35 to S-37 below.

[Chemical Formula 4]

S-35

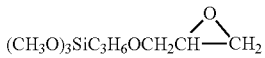

S-36

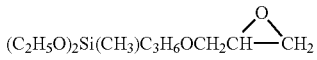

S-37

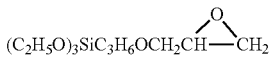

As the manufacturing method of the metal oxide fine particles, may be mentioned a method of using 0.1 to 200 parts by mass of a surface treatment agent and 50 to 5000 parts by mass of a solvent per 100 parts by mass of untreated metal oxide fine particles with a wet media dispersion-type apparatus.

Also, by wet-dispersing a slurry (a suspension of solid particles) containing the untreated metal oxide fine particles and the surface treatment agent, an aggregate of the untreated metal oxide fine particles is crushed while a surface treatment of the untreated metal oxide fine particles is proceeded. Thereafter, the solvent is removed to obtain a powder product. Therefore, there can also be obtained uniform and finer metal oxide fine particles which were surface treated with the surface treatment agent.

The surface treating amount of the surface treatment agent (the coating amount of the surface treatment agent) is preferably not less than 0.1% by mass and not more than 60% by mass per the metal oxide fine particles. Particularly preferable is not less than 5% by mass and not more than 40% by mass.

The surface treating amount of the surface treatment agent is obtained by thermally treating the metal oxide fine particles subjected to a surface treatment at 550° C. for 3 hours, quantitatively analyzing the residue on ignition by X-ray fluorescence, and performing calculation based on an Si amount in terms of a molecular weight.

The wet media dispersion-type apparatus is an apparatus having steps of charging beads as a medium in a container, and rotating at high speed a stirring disc mounted vertically to a rotation axis to crush aggregated particles of the metal oxide fine particles and pulverize and disperse the crushed particles. The apparatus may have any structure as long as the untreated metal oxide fine particles can be sufficiently dispersed when the untreated metal oxide fine particles are subjected to a surface treatment, and performs a process scheme that allows a surface treatment to be performed. For example, various schemes such as vertical or horizontal and continuous or batch can be adopted. Specifically, a sand mill, an Ultra Visco Mill, a Perl Mill, a Glen Mill, a Dyno-Mill, an agitator mill, a dynamic mill and the like can be used. In these dispersion-type apparatuses, fine pulverization and dispersion are performed using a pulverizing medium such as balls and beads by impact crushing, friction, shear, shear stress and the like. As the beads used in the dispersion-type apparatus, can be used balls that are made of, as a raw material, glass, alumina, zircon, zirconia, steel, flint and the like. In particular, the beads made of zirconia and zircon are preferable. The size of the beads to be used is typically about 1 mm to 2 mm in diameter. In the present invention, the beads having a diameter of about 0.3 mm to 1.0 mm are preferably used.

As a material of the disc and the container's inner wall to be used in the wet media dispersion-type apparatus, can be used various materials such as stainless, nylon and ceramics. In the present invention, the disc and the container's inner wall made of ceramics such as zirconia or silicon carbide are particularly preferable.

By the wet treatment as described above, there can be obtained metal oxide fine particles having been subjected to a surface treatment with the surface treatment agent.

The metal oxide fine particles as described above are preferably contained at a ratio of 5 to 25% by mass per the active energy ray-curable composition.

Also, the metal oxide fine particles are preferably contained at a ratio of 5 to 25% by mass in the surface layer.

Other Additives:

In the active energy ray-curable composition, can be contained, as necessary, additive components such as organic solvents, light stabilizers, UV absorbers, catalysts, colorants, antistatic agents, lubricants, leveling agents, antifoaming agents, polymerization accelerators, antioxidants, frame retardants, infrared light absorbers, surfactants and surface modifying agents.

In view of uniform solubility and dispersion stability of the active energy ray-curable composition, as well as adhesion with an endless belt-shaped substrate, and smoothness and uniformity of the coated film, the organic solvent is formulated in the active energy ray-curable composition for use. The organic solvent is not particularly limited as long as the above-described performances are satisfied. As specific examples of the organic solvent, may be mentioned alcohol-based, hydrocarbon-based, halogenated hydrocarbon-based, ether-based, ketone-based, ester-based, and polyhydroxy alcohol derivative solvents.

The layer thickness of the surface layer 4 is preferably 1 to 5 μm, in view of mechanical strength, image quality, manufacturing cost and the like.

Manufacturing Method of Transfer Member:

In the manufacturing method of the transfer member 1 according to the present invention, for example, the substrate 2 is coated with an elastic body layer-forming coating liquid for forming the elastic body layer 3 to form a coated film. The coated film is dried to form the elastic body layer 3. The elastic body layer 3 is coated with a surface layer-forming coating liquid for forming the surface layer 4 to form a coated film. The coated film is irradiated with active energy rays to be cured. In this manner, the surface layer 4 is formed.

As a manufacturing method of the substrate 2, when a polyimide resin is used as a constituent material, a conventional appropriate method may be performed. For example, there is a method of developing a polyamic acid solution into a ring shape in an appropriate manner of immersing the outer peripheral surface of a cylindrical mold in the solution, coating the inner circumference surface thereof with the polyamic acid solution and further centrifuging the solution, or charging the solution in an injection mold. Then, the developed layer is dried and film-formed to be molded into a belt shape. The molded product is heat-treated to convert the polyamic acid into imide, and the obtained imide is released from the mold. See, for example, Japanese Patent Application Laid-open No. Sho. 61-95361, Japanese Patent Application Laid-open No. Sho. 64-22514, and Japanese Patent Application Laid-Open No. Hei. 3-180309.) During the manufacturing of the endless belt-shaped substrate, may be performed an appropriate treatment such as a mold releasing treatment and a defoaming treatment.

As an example of the preparation method of the elastic body layer-forming coating liquid, may be mentioned a method of adding a constituent material for forming the elastic body layer in a solvent at a ratio of 20 to 30% by mass in terms of a solid content concentration.

As an example of the coating method of the elastic body layer-forming coating liquid, may be mentioned spiral coating using a nozzle.

The surface layer-forming coating liquid contains the active energy ray-curable composition that contains at least three ingredients of the multifunctional (meth)acrylate, the polyurethane acrylate, and the polymerizable component having the low surface energy group; the metal oxide fine particles subjected to a surface treatment; a polymerization initiator; and as necessary, other components such as a solvent.

As an example of the preparation method of the surface layer-forming coating liquid, may be mentioned a method of adding the active energy ray-curable composition and the metal oxide fine particles subjected to a surface treatment in a solvent at a ratio of 3 to 10% by mass in terms of a solid content concentration, and dispersing the liquid using, for example, the wet media dispersion-type apparatus. As the wet media dispersion-type apparatus, can be adopted various forms such as vertical or horizontal and continuous or batch. Specifically, a sand mill, an Ultra Visco Mill, a Perl Mill, a Glen Mill, a Dyno-Mill, an agitator mill, a dynamic mill and the like can be used. In these dispersion-type apparatuses, fine pulverization and dispersion are performed using a pulverizing medium such as balls and beads by impact crushing, friction, shear, shear stress and the like.

As examples of the beads to be used in the dispersion-type apparatus, can be used balls which are made of, as a raw material, glass, alumina, zircon, zirconia, steel, flint and the like. Particularly, the beads made of zirconia and zircon are preferable. The size of the beads to be used is typically about 1 mm to 2 mm in diameter. In the present invention, the beads having a diameter of about 0.3 mm to 1.0 mm are preferably used.

As a material of the disc and the container's inner wall to be used in the wet media dispersion-type apparatus, can be used various materials such as stainless, nylon and ceramics. In the present invention, the disc and the container's inner wall made of ceramics such as zirconia or silicon carbide are particularly preferable.

The dispersion is preferably terminated in a dispersion state in which the change ratio of the optical transmission at 405 nm of the dried film of the dispersion liquid, which is coated on a PET film using a wire bar and air-dried, to the optical transmission of the dried film of the dispersion liquid an hour ago is not higher than 3%. Further desirably, not higher than 1% is preferable.

By the dispersion treatment described above, the surface layer-forming coating liquid can be obtained.

The polymerization initiator to be contained in the surface layer-forming coating liquid is not particularly limited, as long as the active energy ray-curable composition can be polymerized with active energy rays such as light.

As examples of the polymerization initiator, may be used photopolymerization initiators such as acetophenone-based compounds, benzoin ether-based compounds, benzophenone-based compounds, sulfur compounds, azo compounds, peroxide compounds, and phosphine oxide-based compounds.

As specific examples thereof, may be mentioned carbonyl compounds such as benzoin, benzoin methyl ether, benzoin ethyl ether, benzoin isopropyl ether, acetoin, butyroin, toluoin, benzyl, benzophenone, p-methoxybenzophenone, diethoxyacetophenone, α,α-dimethoxy-α-phenylacetophenone, methyl phenylglyoxylate, ethyl phenylglyoxylate, 4,4'-bis(dimethylamino benzophenone), 2-hydroxy-2-methyl-1-phenylpropane-1-one, 2,2-dimethoxy-1,2-diphenylethan-1-one and 1-hydroxycyclohexyl phenyl ketone; sulfur compounds such as tetramethylthiuram monosulfide and tetramethylthiuram disulfide; azo compounds such as azobisisobutyronitrile and azobis-2,4-dimethylvaleronitrile; and peroxide compounds such as benzoyl peroxide and di-t-butyl peroxide. These may be used either singly or in any combination thereof.

Among these, since light stability, highly efficient photocleavage, surface curing properties, compatibility with cured resins, low volatility and low odor are obtained, 1-hydroxycyclohexyl phenyl ketone, 2-hydroxy-2-methyl-1-phenylpropan-1-one, and 1-[4-(2-hydroxyethoxy)phenyl]-2-hydroxy-2-methyl-1-propan-1-one are preferably used.

The content ratio of the polymerization initiator in the surface layer-forming coating liquid is preferably 1 to 10% by mass. Since high adhesion to the elastic body layer can be obtained while an excellent curing property and a sufficient hardness of the obtained specific surface layer are obtained, the content ratio of the polymerization initiator is more preferably 2 to 8% by mass, further preferably 3 to 6% by mass.

Since a coating property (workability) becomes favorable, the surface layer-forming coating liquid preferably contains a solvent.

As specific examples of the solvent, may be mentioned ethanol, isopropanol, butanol, toluene, xylene, acetone, methyl ethyl ketone, ethyl acetate and butyl acetate.

The viscosity of the surface layer-forming coating liquid is preferably 10 to 100 cP.

The solid content concentration of the surface layer-forming coating liquid is preferably 3 to 10% by mass. Here, the solid content in the surface layer-forming coating liquid is the metal oxide fine particles, as well as the multifunctional (meth)acrylate, the polyurethane acrylate and the polymerizable component having the low surface energy group.

As an example of the coating method of the surface layer-forming coating liquid, may be mentioned spray coating.

As an example of the curing method of the active energy ray-curable composition, may be mentioned a method of irradiating active energy rays.

As examples of the active energy rays, may be mentioned ultraviolet rays, electron beams and γ rays. The active energy rays to be used are not particularly limited, and may be any energy source that activates the formed active energy ray-curable resin. However, ultraviolet rays and electron beams are preferable. Since handling is particularly simple and high energy can be easily obtained, ultraviolet rays are preferable. As the light source of ultraviolet rays, any light source can be used as long as the light source generates ultraviolet rays. For example, a low pressure mercury lamp, a medium pressure mercury lamp, a high pressure mercury lamp, an ultra-high pressure mercury lamp, a carbon arc lamp, a metal halide lamp and a xenon lamp can be used. Furthermore, an ArF excimer laser, a KrF excimer laser, an excimer lamp, synchrotron radiation or the like can also be used. In order to irradiate spot-like active energy rays, an ultraviolet laser is preferably used.

Electron beams can be similarly used. As an example of electron beams, may be mentioned electron beams having an energy of 50 keV to 1000 keV, preferably 100 keV to 300 keV emitted from various electron beam accelerators such as Cockcroft-Walton type, Van de Graaff type, resonance transformer type, insulated core transformer type, linear type, Dainamitoron type and high-frequency type.

Although the irradiation condition varies depending on a light source, the irradiated light amount is preferably not less than 100 mJ/cm$^2$, further preferably 120 to 200 mJ/cm$^2$, particularly preferably 150 to 180 mJ/cm$^2$ in view of curing unevenness, hardness, a curing time, a curing speed and the like.

The irradiated light amount indicates a value measured using UIT250 (manufactured by Ushio Inc.).

The irradiation time of the active energy rays is preferably 0.5 seconds to 5 minutes. From the viewpoint of curing efficiency and working efficiency, the irradiation time is further preferably 8 seconds to 2 minutes.

Regarding the atmosphere during the irradiation of the active energy rays, curing can be performed without problems in an air atmosphere. In view of curing unevenness, a curing time and the like, the oxygen concentration in the atmosphere is preferably not more than 5%, particularly preferably not more than 1%. To achieve such an atmosphere, nitrogen gas or the like is effectively introduced.

The oxygen concentration is represented by a value measured using an atmospheric gas-controlling oxygen concentration meter "OX100" (manufactured by Yokogawa Electric Corporation).

It is preferable that the surface layer-forming coating liquid is dried after coated on the elastic body layer 3. At that time, the solvent is removed.

The coated film may be dried at any time before, during or after the polymerization of the polymerizable component, and the timings can be combined and appropriately selected. Specifically, it is preferable that after the first drying is performed to a degree of losing a flow property of the coated film, the polymerization of the polymerizable component is performed, and thereafter, the second drying is performed to achieve a defined amount of a volatile substance in the surface layer.

Although the drying method of the coated film may be appropriately selected depending on the type of the solvent, the layer thickness of the surface layer to be formed, and the like, the drying temperature is, for example, preferably 40 to 100° C., further preferably about 60° C. The drying time is, for example, preferably 1 to 5 minutes, further preferably about 3 minutes.

Image Formation Apparatus:

The transfer member described above can be suitably used as an intermediate transfer belt in various publicly known image formation apparatuses of an electrophotographic system, such as a monochrome image formation apparatus or a full color image formation apparatus.

Figure 2:
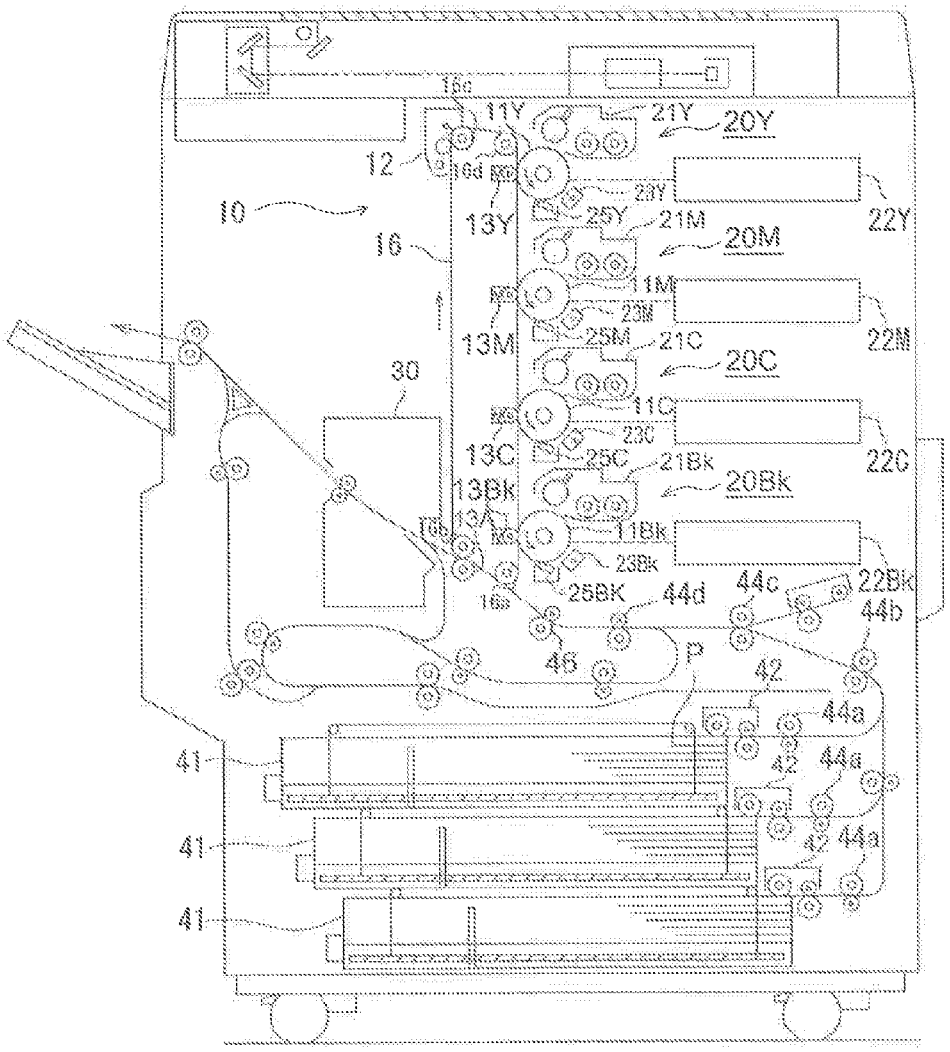
FIG. 2 is an explanatory sectional view illustrating an example of the configuration of the image formation apparatus according to the present invention.

FIG. 2 is an explanatory sectional view illustrating an example of the configuration of an image formation apparatus including the transfer member according to the present invention.

This image formation apparatus includes: a plurality of image formation units 20Y, 20M, 20C and 20Bk; an intermediate transfer part 10 that transfers onto an image support P a toner image formed by each of the image formation units 20Y, 20M, 20C and 20Bk; and a fixing apparatus 30 that performs a fixing treatment of pressurizing while heating the image support P for fixing the toner image to obtain a toner layer.

In the image formation unit 20Y, toner image formation of yellow color is performed. In the image formation unit 20M, toner image formation of magenta color is performed. In the image formation unit 20C, toner image formation of cyan color is performed, and in the image formation unit 20Bk, toner image formation of black color is performed.

The image formation units 20Y, 20M, 20C and 20Bk respectively include photoreceptors 11Y, 11M, 11C and 11Bk that are electrostatic latent image carriers; charging units 23Y, 23M, 23C and 23Bk that provide uniform potentials on the surfaces of the photoreceptors 11Y, 11M, 11C and 11Bk; exposure units 22Y, 22M, 22C and 22Bk that form electrostatic latent images having a desired shape on the uniformly charged photoreceptors 11Y, 11M, 11C and 11Bk; developing units 21Y, 21M, 21C and 21Bk that deliver chromatic color toners onto the photoreceptors 11Y, 11M, 11C and 11Bk to visualize the electrostatic latent images; and cleaning units 25Y, 25M, 25C and 25Bk that collect residual toners remaining on the photoreceptors 11Y, 11M, 11C and 11Bk after the primary transfer.

The intermediate transfer part 10 includes: an intermediate transfer belt 16 that moves in circulation; primary transfer rollers 13Y, 13M, 13C and 13Bk as primary transfer units that respectively transfer the toner images forced by the image formation units 20Y, 20M, 20C and 20Bk onto the intermediate transfer belt 16; a secondary transfer roller 13A as a secondary transfer unit that transfers onto the image support P a chromatic color toner image transferred onto the intermediate transfer belt 16 by the primary transfer rollers 13Y, 13M, 13C and 13Bk; and a cleaning unit 12 that collects a residual toner remaining on the intermediate transfer belt 16.

The transfer member according to the present invention is used as the intermediate transfer belt 16.

This intermediate transfer belt 16 is an endless belt that stretched across a plurality of support rollers 16*a* to 16*d* is rotatably supported by the same.

Furthermore, the intermediate transfer belt 16 is configured to include a specific surface layer that contains the cured resin and the metal oxide fine particles according to the present invention formed on the outer peripheral surface of the elastic body layer on the substrate.

The toner image of each color formed by each of the image formation units 20Y, 20M, 20C and 20Bk as sequentially transferred on the rotating endless intermediate transfer belt 16 by each of the primary transfer rollers 13Y, 13M, 13C and 13Bk to form a superimposed color image. The image support P housed in a paper feed cassette 41 is fed by a paper sheet delivering unit 42, passes through a plurality of intermediate rollers 44*a* to 44*d* and a resist roller 46, and is delivered to the secondary transfer roller 13A as a secondary transfer unit. In this manner, the color image is collectively transferred onto the image support P.

The image support P having the color image transferred thereon as subjected to a fixing treatment by the fixing apparatus 30 equipped with a thermal roller fixing device, sandwiched by paper output rollers, and placed on a paper output tray outside the image formation apparatus.

On the other hand, the cleaning unit 12 removes the residual toner on the endless intermediate transfer belt 16, from which the image support P is curvature-separated after the color image is transferred on the image support P by the secondary transfer roller 13A.

According to the image formation apparatus described above, since the intermediate transfer belt is constituted by the transfer member according to the present invention, the intermediate transfer belt can have high durability while having an excellent transfer function. Therefore, high quality images can be formed for an extended period of time.

Developer:

The developer used in the image formation apparatus according to the present invention may be a one-component developer including a magnetic or non-magnetic toner, or a two-component developer including a toner and a carrier mixed therein.

The toner constituting the developer is not particularly limited, and various publicly known toners can be used. For example, a so-called polymerized toner which has a volume-based median diameter of 3 to 9 μm and is obtained by a polymerization method is preferably used. By using the polymerized toner, an occurrence of image fogging is remarkably suppressed while a high resolution and a stable image density can be obtained in the formed image.

When the two-component developer is constituted, the carrier is not particularly limited, and various publicly known carriers can be used. For example, a ferrite carrier made of magnetic particles having a volume-based median diameter of 30 to 65 μm and a magnetization amount of 20 to 70 emu/g is preferable. When a carrier having a volume-based median diameter of smaller than 30 μm is used, attachment of the carrier may cause an occurrence of a white patch image. Also, when a carrier having a volume-based median diameter of larger than 65 μm is used, an image having a uniform image density may not be formed in some cases.

Image Support:

As specific examples of the image support P used in the image formation apparatus according to the present invention, may be mentioned, but not limited to, various products such as plain papers with a thickness of thin to thick, high quality papers, coated printing papers such as art papers and coated papers, commercially available Japanese papers and postcard papers, OHP plastic films, and cloth.

EXAMPLES

Transfer Member Manufacturing Example 1

(1) Preparation of Endless Belt-Shaped Substrate

To an N-methyl-2-pyrrolidone (NMP) solution of a polyamic acid including 3,3',4,4'-biphenyltetracarboxylic acid dianhydride (BPDA) and p-phenylene diamine (PDA), a product name of "U-Varnish S (solid content: 18% by mass)" (manufactured by Ube Industries, Ltd.), a dried oxidation-treated carbon black "SPECIAL BLACK 4" (manufactured by Degussa, ph 3.0, volatile component: 14.0%) was added in an amount of 23 parts by mass per 100 parts by mass of the polyimide-based resin solid content. Next, using a collision type dispenser "Geanus PY" (manufactured by Geanus), the solution was divided into two parts, and then collided at a pressure of 200 MPa and a minimum area of 1.4 $mm^2$. Thereafter, the solution was allowed to pass through a passage of being divided into two again five times to be mixed. Thus, a carbon black-containing polyamic acid solution was obtained.

The inner circumference surface of a cylindrical mold was coated with the obtained carbon black-containing polyamic acid solution via a dispenser to a thickness of 0.5 mm, and was rotated at 1500 rpm for 15 minutes to obtain a developing layer having a uniform thickness. Thereafter, the mold was blown with hot air from the outside of the mold at 60° C. for 30 minutes while being rotated at 250 rpm, and then heated at 150° C. for 60 minutes. Thereafter, the temperature was increased to 360° C. at a temperature rise rate of 2° C./minute, and heating was further performed at 360° C. for 30 minutes. Thus, removal of the solvent, removal of dehydration ring-closing water, and completion of an imide conversion reaction were achieved. Thereafter, the temperature was returned to room temperature, and the obtained product was peeled from the cylindrical mold. Thus, an endless belt-shaped substrate having a thickness of 0.1 mm was prepared.

(2) Formation of Elastic Body Layer

Furnace black (manufactured by Asahi Carbon Co., Ltd.) was kneaded with chloroprene rubber (manufactured, by Denki Kagaku Kogyo Kabushiki Kaisha) in an amount of 30 parts by mass. The compound was dissolved and dispersed in toluene as a solvent to obtain a solid content concentration of 20% by mass. Thus, an elastic body layer-forming coating liquid [1] was prepared.

The endless belt-shaped substrate [1] was coated with the elastic body layer-forming coating liquid [1] by spiral coating with a nozzle to form an elastic body layer [1] having a dry film thickness of 200 μm.

(3) Preparation of Surface Layer-Forming Coating Liquid 40 parts by mass of dipentaerythritol hexaacrylate (DPHA) as a multifunctional (meth)acrylate, 45 parts by mass or a polyurethane acrylate, "UV-3520TL" (manufactured by The Nippon Synthetic Chemical Industry Co., Ltd.), 10 parts by mass of a polymerizable component having a low surface energy group, "Megafac" (manufactured by DIC Corporation), and 5 parts by mass of metal oxide fine particles made of tin oxide (surface treatment agent (S-5) were dissolved and dispersed in propylene glycol monomethyl ether acetate (PMA) to obtain a solid content concentration of 10% by mass. Thus, a surface layer-forming coating liquid [1] wear prepared.

(4) Formation of Surface Layer

The outer peripheral surface of the elastic body layer [1] was coated with the surface layer-forming coating liquid [1] using a coating applicator by an immersion coating method under the coating condition described below to obtain a coated film having a dry film thickness of 2 μm. The obtained coated film was irradiated with ultraviolet rays as active energy rays under the irradiation condition described below to cure the coated film and form a surface layer. Thus, a transfer member [1] was obtained. Irradiation of ultraviolet rays was performed with a light source being fixed and while rotating the substrate that includes the coated film feasted on the outer peripheral surface of the elastic body layer at a peripheral speed of 60 mm/s.

—Coating Condition—

Coating liquid supply amount: 1 L/min

—Irradiation Condition of Ultraviolet Rays—

Type of light source: high pressure mercury lamp "H04-L41" (manufactured by Eye Graphics Co., Ltd.)

Distance from irradiation hole to the surface of the coated film: 100 mm

Irradiation light amount: 1 $J/cm^2$

Irradiation time (substrate rotation time): 240 seconds

Transfer Member Manufacturing Examples 2 to 10:

Each of transfer members [2] to [10] was manufactured in the same manner as in the transfer member manufacturing example 1, except that the surface layer-forming coating liquid was prepared according to the formulation of TABLE 1 in the preparation step of the surface layer-forming coating liquid, and the prepared surface layer-forming coating liquid was used in the formation step of the surface layer.

TABLE 1

| | Active energy ray-curable composition | | | | | | | | |
|---|---|---|---|---|---|---|---|---|---|
| | Multifunctional (meth)acrylate | | Polyurethane acrylate | | Polymerizable component having low surface energy group | | Metal oxide fine particles | | |
| Transfer member No. | Type | Added amount (parts by mass) | Type | Added amount (parts by mass) | Type | Added amount (parts by mass) | Type | Surface treatment agent | Added amount (parts by mass) |
| (1) | DPHA (Molecular weight: 578) | 40 | UV-3520TL (Molecular weight: about 18000, Elongation: 320%, Tensile strength: 400 kg/cm$^2$) | 45 | Megafac (manufactured by DIC Corporation) (Low surface energy group: *1) | 10 | Tin oxide | S-5 | 5 |
| (2) | PETTA (Molecular weight: 298) (Pentaerythritol tetraacrylate) | 30 | AU-3110 (manufactured by Tokushiki Co., Ltd.) (Molecular weight: about 10000, Elongation: 400%, Tensile strength: 250 kg/cm$^2$) | 30 | FulShade (manufactured by Toyo Ink Co., Ltd.) (Low surface energy group: *2) | 30 | Alumina | S-30 | 10 |
| (3) | DPHA | 30 | UV-3520TL | 40 | Megafac | 30 | — | — | 0 |
| (4) | DPHA | 50 | — | 0 | Megafac | 30 | Tin oxide | S-5 | 20 |
| (5) | — | 0 | UV-3520TL | 60 | FulShade | 10 | Tin oxide | S-30 | 30 |
| (6) | DPHA | 40 | UV-3520TL | 50 | — | 0 | Alumina | S-5 | 10 |
| (7) | — | 0 | UV-3520TL | 50 | FulShade | 50 | — | — | 0 |
| (8) | PETTA | 50 | AU-3110 | 50 | — | 0 | — | — | 0 |
| (9) | DPHA | 95 | — | 0 | — | 0 | Alumina | S-30 | 5 |
| (10) | PETTA | 30 | U-6LPA (manufactured by Shin Nakamura Chemical Co., Ltd.) (Molecular weight: 800, Elongation: not more than 50%, Tensile strength: not higher than 1000 kg/cm$^2$) | 40 | FulShade | 30 | — | — | 0 |

*1: Fluorine-modified acrylate group (A fluorine-modified site is PTFE)
*2: Silicone-modified acrylate group (A silicone-modified site is dimethylpolysiloxane)

Evaluation 1: Bending Cracks:

Each of the transfer members <1> to <10> obtained as described above was wound around each of cylindrical members having a diameter of 5 mm, 10 mm and 20 mm, and retained for 60 seconds. Thereafter, the surface was visually observed to check the state of cracks. Evaluation was performed in accordance with the evaluation criteria below. The results are shown in TABLE 2.

—Evaluation Criteria—

A: No cracks at a diameter of 5 mm

B: No cracks at a diameter of 10 mm

C: No cracks at a diameter of 20 mm

Evaluation 2: Paper Sheet Edge Flaws:

An edge part of a paper sheet having a thickness of 400 μm was pressed against the surface of each of the transfer members [1] to [10] obtained as described above at a surface pressure of 80 N/cm$^2$. Rotational driving was performed to observe the state of flaws in the edge area of the transfer member. Evaluation was performed in accordance with the evaluation criteria below. The results are shown in TABLE 2.

—Evaluation Criteria—

A: No flaws were observed after 10000 pieces of paper were subjected to the pressure durability test as above.

B: No flaws were observed after 5000 pieces of paper were subjected to the pressure durability test as above.

C: Flaws were observed before 5000 pieces of paper were subjected to the pressure durability test as above.

Evaluation 3: Attachment of Foreign Substances:

Each of the transfer members [1] to [10] was mounted as an intermediate transfer body in an image formation apparatus "C6000" (manufactured by Konica Minolta Business Technologies, Inc.), and durability printing was performed. The surface states before and after the durability printing were observed. In the evaluation, attention was paid on a fact trust attachment of foreign substances causes a color tone to change from an initial state. Therefore, the color tone was measured using a spectrophotometer "CM-2600d" (manufactured by Konica Minolta Inc.), and difference in color before and after the durability printing was calculated. The results are shown in TABLE 2.

—Evaluation Criteria—

A: Color difference is not larger than 10 at the durability number of 500000 pieces of paper printed.

B: Color difference is not larger than 10 at the durability number of 300000 pieces of paper printed.

C: Color difference is not larger than 10 at the durability number of 100000 pieces of paper printed.

Evaluation 4: Transfer Property of Uneven Paper Sheets:

Each of the transfer members [1] to [10] was mounted as an intermediate transfer body in an image formation apparatus "C6000" (manufactured by Konica Minolta Business Technologies, Inc.). An image having a toner concentration of 100% (a solid image) was output on an uneven paper sheet (a Leathac paper sheet), and the image density thereof was measured. Then, evaluation was performed in accordance with the evaluation criteria below. The results are shown in TABLE 2. The image density was obtained by scanning an image and calculating an average density by image processing using a Photoshop (manufactured by Adobe). Then, comparison was performed in accordance with the evaluation criteria below.

—Evaluation Criteria—

A: Area having an average density of not higher than 90% is not larger than 3%.

B: Area having an average density of not higher than 90% is not larger than 5%.

C: Area having an average density of not higher than 90% is not larger than 10%.

TABLE 2

| | | Evaluation | | | |
|---|---|---|---|---|---|
| | Transfer member No. | Bending cracks | Paper sheet edge flaws | Adherence of foreign substances | Uneven paper sheet transfer property |
| Example1 | [1] | A | A | A | A |
| Example2 | [2] | A | A | A | A |
| Comparative example1 | [3] | A | B | A | A |
| Comparative example2 | [4] | C | A | A | B |
| Comparative example3 | [5] | A | B | A | A |
| Comparative example4 | [6] | A | B | A | A |
| Comparative example5 | [7] | A | C | C | A |
| Comparative example6 | [8] | A | C | C | A |
| Comparative example7 | [9] | C | A | A | C |
| Comparative example8 | [10] | A | B | A | A |

REFERENCE SIGNS LIST

1 Transfer member
2 Substrate
3 Elastic body layer
4 Surface layer
10 Intermediate transfer part
11Y, 11M, 11C, 11Bk Photoreceptor
12 Cleaning unit
13Y, 13M, 13C, 13Bk Primary transfer roller
13A Secondary transfer roller
16 Intermediate transfer belt
16*a* to 16*d* Support roller
20Y, 20M, 20C, 20Bk Image formation unit
21Y, 21M, 21C, 21Bk Developing unit
22Y, 22M, 22C, 22Bk Exposure unit
23Y, 23M, 23C, 23Bk Charging unit
25Y, 25M, 25C, 25Bk Cleaning unit
30 Fixing apparatus
41 Paper feed cassette
42 Paper sheet delivering unit
44*a*, 44*b*, 44*c*, 44*d* Paper feed roller
46 Resist roller
N1 Fixing nip part
P Image support

The invention claimed is:

1. A transfer member that has an endless belt shape and constitutes an image formation apparatus of an electrophotographic system, the transfer member comprising:

an elastic body layer, and a surface layer formed on the elastic body layer, wherein the surface layer contains metal oxide fine particles subjected to a surface treatment, in a cured resin obtained by curing an active energy ray-curable composition that contains three ingredients of a multifunctional (meth) acrylate, a polyurethane acrylate and a polymerizable component having a low surface energy group, a content of the polyurethane acrylate is 20 to 50% by mass in the active energy ray-curable composition, and the polymerizable component having the low surface energy group is a vinyl copolymer that has a number average molecular weight of not less than 5,000 and not more than 100,000, contains one or more polyorganosiloxane chains or polyfluoroalkyl chains, and contains three or more radical polymerizable double bonds.

2. The transfer member according to claim 1, wherein the polyurethane acrylate has a number average molecular weight of not less than 10,000, an elongation of not less than 250%, and a tensile strength of not less than 200 kg/cm$^2$.

3. The transfer member according to claim 1, wherein the elastic body layer contains a cross-linked rubber material.

4. The transfer member according to claim 1, wherein the metal oxide fine particles are those subjected to a surface treatment with at least one selected from the group consisting of a silane compound having any of an acryloyl group and a methacryloyl group, a silicone oil and a compound having a polyfluoroalkyl group.

5. The transfer member according to claim 1, comprising a substrate, wherein the elastic body layer is formed on the substrate and the surface layer is formed on the elastic body layer.

6. The transfer member according to claim 5, wherein the substrate has a layer thickness of 50 to 250 μm.

7. The transfer member according to claim 1, wherein the metal oxide fine particles have a number average primary particle diameter of not smaller than 1 nm and not larger than 300 nm.

8. An image formation apparatus of an electrophotographic system, comprising:

a primary transfer unit that performs primary transfer of transferring a toner image electrostatically formed on an image carrier onto an intermediate transfer belt that moves in circulation; and a secondary transfer unit that performs secondary transfer of transferring an intermediate toner image formed on the intermediate transfer belt onto an image support, wherein the intermediate transfer belt is constituted by the transfer member according to claim 1.

* * * * *